US007191770B1

(12) United States Patent
Anderson et al.

(10) Patent No.: US 7,191,770 B1
(45) Date of Patent: Mar. 20, 2007

(54) INSULATED CYLINDER LINER FOR A MARINE ENGINE

(75) Inventors: Kevin R. Anderson, Fond du Lac, WI (US); Eric S. Mueller, Fond du Lac, WI (US); Christopher J. Misorski, Fond du Lac, WI (US); Mitesh B. Sheth, Colorado Springs, CO (US)

(73) Assignee: Brunswick Corporation, Lake Forest, IL (US)

( * ) Notice: Subject to any disclaimer, the term of this patent is extended or adjusted under 35 U.S.C. 154(b) by 16 days.

(21) Appl. No.: 11/146,769

(22) Filed: Jun. 7, 2005

(51) Int. Cl.
*F02B 77/02* (2006.01)

(52) U.S. Cl. ..... 123/668; 123/193.2; 123/669

(58) Field of Classification Search ..... 123/193.2, 123/668, 669
See application file for complete search history.

(56) References Cited

U.S. PATENT DOCUMENTS

| | | | | |
|---|---|---|---|---|
| 4,447,275 A | | 5/1984 | Hiraoka et al. | 148/152 |
| 4,523,554 A | * | 6/1985 | Ryu | 123/193.2 |
| 4,662,321 A | | 5/1987 | Devaux | 123/41.79 |
| 4,774,926 A | * | 10/1988 | Adams | 123/668 |
| 4,903,652 A | | 2/1990 | Field et al. | 123/193 C |
| 4,921,734 A | * | 5/1990 | Thorpe et al. | 123/193.2 |
| 5,115,771 A | | 5/1992 | Ozawa | 123/41.72 |
| 5,165,367 A | | 11/1992 | Morris | 123/41.84 |
| 5,687,679 A | * | 11/1997 | Mullin et al. | 123/668 |
| 5,829,405 A | * | 11/1998 | Godel | 123/193.2 |
| 6,044,820 A | | 4/2000 | Domanchuk et al. | 123/193.2 |
| 6,123,052 A | | 9/2000 | Jahn | 123/41.79 |
| 6,182,629 B1 | | 2/2001 | Gobbels et al. | 123/193.2 |
| 6,220,214 B1 | | 4/2001 | Kojima et al. | 123/193.2 |
| 6,675,750 B1 | | 1/2004 | Wagner | 123/41.84 |
| 6,732,698 B1 | | 5/2004 | Bedwell et al. | 123/193.2 |

* cited by examiner

*Primary Examiner*—Erick Solis
(74) *Attorney, Agent, or Firm*—William D. Lanyi

(57) ABSTRACT

An engine is made by providing a layer of material between the outer surface of a cylinder liner and the inner surface of the cylinder opening within an engine block. The material can be a polymer or a ceramic. Polyether ether ketone or polyethylene terephthalate can be a polymer used for these purposes. Zirconia or yttria can be ceramic used for these purposes. An electro-deposited paint can serve as the layer of thermally insulative material.

5 Claims, 4 Drawing Sheets

INSULATED CYLINDER LINER FOR A MARINE ENGINE

BACKGROUND OF THE INVENTION

1. Field of the Invention

The present invention is generally related to a cylinder liner for an internal combustion engine and, more particularly, to a cylinder liner for a marine engine that provides an improved degree of insulation between the temperature within the cylinder and the temperature in cooling passages formed in the engine block.

2. Description of the Prior Art

U.S. Pat. No. 4,447,275, which issued to Hiraoka et al. on May 8, 1984, describes a cylinder liner for an internal combustion engine. The liner has a white cast iron layer formed by remelting and cooling a part or whole of areas of the outer peripheral surface of the cylinder liner. A thermally affected layer is also formed between the white cast iron layer and the parent material. This cylinder liner has improved anti-cavitation properties.

U.S. Pat. No. 4,662,321, which issued to Devaux on May 5, 1987, describes a method and apparatus for regulating the temperature of the inside surface of internal combustion engine cylinder liners. The device provides a method of regulating the temperature of the inside surface of cylinder liners in an internal combustion engine which is cooled by a flow of cooling fluid. The method includes the improvement whereby the temperature of the cooling fluid is regulated in such a manner as to maintain the temperature of the inside surface of the cylinder liners at a reference temperature regardless of the engine load.

U.S. Pat. No. 4,903,652, which issued to Field et al. Feb. 27, 1990, describes a cylinder liner insert and method of making an engine block. The method relates to casting-in-place iron cylinder liners in a light alloy, such as aluminum. Engine blocks can be made by using a cylinder liner insert that comprises at least two generally cylindrical cylinder liners which are joined together along aligned portions of the liners.

U.S. Pat. No. 5,115,771, which issued to Ozawa on May 26, 1992, describes a method of cooling cylinder liners in an engine. It includes an apparatus for cooling a plurality of cylinder liners in an engine with a thermal insulating layer comprising an annular groove which is formed in a region in the vicinity of the upper part of each cylinder liner in the cylinder block while surrounding the upper part of the cylinder liner in a slightly spaced relationship relative to the cylinder liner in order to positively elevate the temperature of the wall surface of the cylinder liner at the upper part of the same and moreover a water jacket is formed in the cylinder block so as to allow coolant to flow from the lower part toward the upper part of the cylinder liner.

U.S. Pat. No. 5,165,367, which issued to Morris on Nov. 24, 1992, describes cylinder liners which have a top boss which is an interference fit in the engine block and a mid-stop flange. The outer portion of the liner between the top boss and mid-stop flange forms a wall of a coolant passage. A cylindrical inner portion of the liner is at least 30% of the length of the liner and has a groove in the outer surface thereof adjacent to the bottom end.

U.S. Pat. No. 6,044,820, which issued to Domanchuk et al. on Apr. 4, 2000, describes a method of providing a cylinder bore liner in an internal combustion engine. The method comprises making an engine block with cylinder bores, forming a spray-formed cylinder liner with a predetermined internal diameter and a predetermined external diameter, heating the cylinder block, inserting the cylinder liner in the bore, and permitting the cylinder block to cool such that the liner is locked in position in the bore by compressive forces.

U.S. Pat. No. 6,123,052, which issued to Jahn on Sep. 26, 2000, describes a waffle cast iron cylinder liner. The cylinder liner is intended for use in an engine block. The liner is cast to have a number of longitudinal grooves and machined to have a number of intersecting annular grooves to create an inverted waffle-like pattern of ridges and grooves on the outer circumferential surface of the liner. This pattern significantly increases the surface area through which cooling of the liner occurs and, thus, increases the liners cooling capacity by approximately 30 to 40 percent.

U.S. Pat. No. 6,182,629, which issued to Gobbels et al. on Feb. 6, 2001, describes a method of making a cylinder liner. A cylinder liner for an internal combustion engine includes a tubular wall having circumferentially spaced thickened wall portions.

U.S. Pat. No. 6,220,214, which issued to Kojima et al. on Apr. 24, 2001, describes a cylinder liner formed with cross-hatching grooves. A cylinder liner formed of a cast iron and having an inner peripheral surface subjected to honing is described. The honing forms cross-hatching grooves on the surface.

U.S. Pat. No. 6,675,750, which issued to Wagner on Jan. 13, 2004, describes a cylinder liner. A cooling system of an internal combustion engine has a wet-sleeve cylinder liner that improves heat reduction efficiency as compared with traditional cylinder liners. The improved liner has an outer surface with a plurality of peaks and valleys. The peaks and valleys create an increased surface area of the outer surface thereby increasing contact with a cooling medium and more efficiently reducing heat within the engine.

U.S. Pat. No. 6,732,698, which issued to Bedwell et al. on May 11, 2004, describes an austempered gray iron cylinder liner and a method of manufacturing it. A cylinder liner for a high temperature, high performance engine is cast from gray iron material and thereafter austempered for a time sufficient to achieve a substantially bainitic microstructure that is stable against excessive thermal growth when the liner is exposed to extreme operating temperatures.

U.S. patent application Ser. No. 10/793,000 (M09720), which was filed by Wynveen et al. on Mar. 4, 2004, discloses an engine that is provided with a plurality of cylinders and cylinder liners that are shaped to define a plurality of spaces between the liners and the engine block. These spaces provide an insulative barrier that at least partially restricts the flow of heat from the liner into the engine block. This allows the liners to operate at elevated temperatures while avoiding a deleterious increase in the cooling water temperature as it flows through the passages within the engine block.

The patents described above are hereby expressly incorporated by reference in the description of the present invention.

Those skilled in the art of engine design are familiar with many types of internal combustion engines that are cooled by providing a cooling fluid, such as water, which flows in thermal communication with heat producing portions of the engine. In automobile applications, the cooling system is a closed system in which a coolant is passed through a heat exchanger, such as an automobile radiator to remove heat from the coolant. The coolant is then recirculated through the engine cooling passages to remove heat from the engine. In certain marine propulsion systems, closed cooling systems are also used. However, in many types of marine propulsion systems, open cooling systems draw water from a body of water in which a marine vessel is operating and then circulate that water through the cooling passages of the engine. After heat has been removed by the water, the heated water is returned to the body of water from which it was originally drawn. Open cooling systems, such as those used in marine propulsion applications, have an inherent problem relating to the relative operating temperatures of various locations within the engine structure. If the temperatures within the cylinders of the engine are not sufficiently high, proper combustion is adversely affected and can result in the dilution of engine oil with liquid fuel in a manner that is known to those skilled in the art. The cooling channels of the engine, on the other hand, must be maintained at a temperature which is low enough to avoid separation of certain salts and minerals from the cooling water which was drawn from the body of water in which the marine vessel operates. If the cooling water passages reach a sufficiently high temperature, these salts and minerals can be deposited, or plated, on the walls of the cooling channels. This deposition of these minerals will adversely affect the thermal conductivity between the cooling channels and the engine block and can also lead to blockage of the cooling channels in some extreme cases. Therefore, in marine applications of open cooling systems, it would be significantly beneficial if the cooling water channels could be maintained at a temperature low enough to avoid the separation and deposition of minerals and salts on the walls of the cooling channels while also maintaining the cylinder temperatures at a sufficiently high magnitude to improve combustion and avoid oil dilution with liquid fuel.

SUMMARY OF THE INVENTION

An engine made in accordance with a preferred embodiment of the present invention comprises a cylinder and a liner disposed in the cylinder. A layer of material is disposed between the outer surface of the liner and the inner surface of the cylinder, wherein the layer of material is selected from the group consisting of ceramics and polymers.

Several polymers that can be used in practice of the invention are polyether ether ketone (PEEK) or a polyethylene terephthalate (PET). If the material is a polymer, in a preferred embodiment of the present invention, it has a glass transition temperature which is higher than the maximum operational temperature of the liner when the engine is operating.

The material can also be an electro-deposited paint (EDP) which can incorporate a polymeric epoxy based paint.

The material can also be a ceramic, such as zirconia (zirconium oxide) or yttria (yttrium oxide).

In a particularly preferred embodiment of the present invention, the layer of material is disposed on the outer surface of the liner prior to insertion of the liner into the cylinder. The material can be sprayed, injection molded, powder coated, electrically deposited or applied by other processes onto the outer surface of the liner. In one preferred embodiment of the present invention, a polymer material is first formed into a sheath which is then disposed around the outer surface of the metallic cylinder liner. The sheath is then heated to cause it to shrink onto the cylinder liner and form a polymer coating surrounding the outer surface of the liner.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 2:
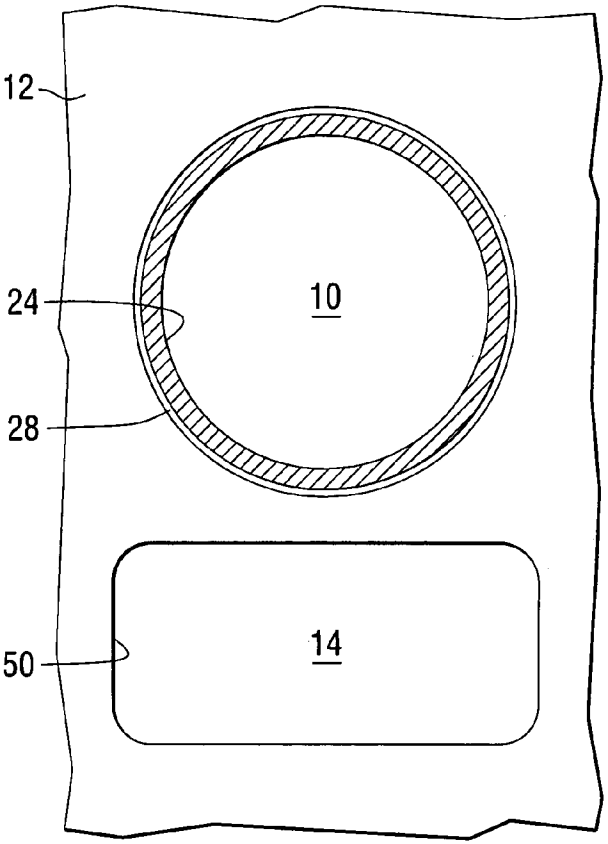
FIG. 2 PRIOR ART
FIGS. 1 and 2 are simplified schematic representations of two known techniques for insulating cooling water channels from cylinders of an engine.

Throughout the description of the preferred embodiment of the present invention, like components will be identified by like reference numerals.

Figure 1:
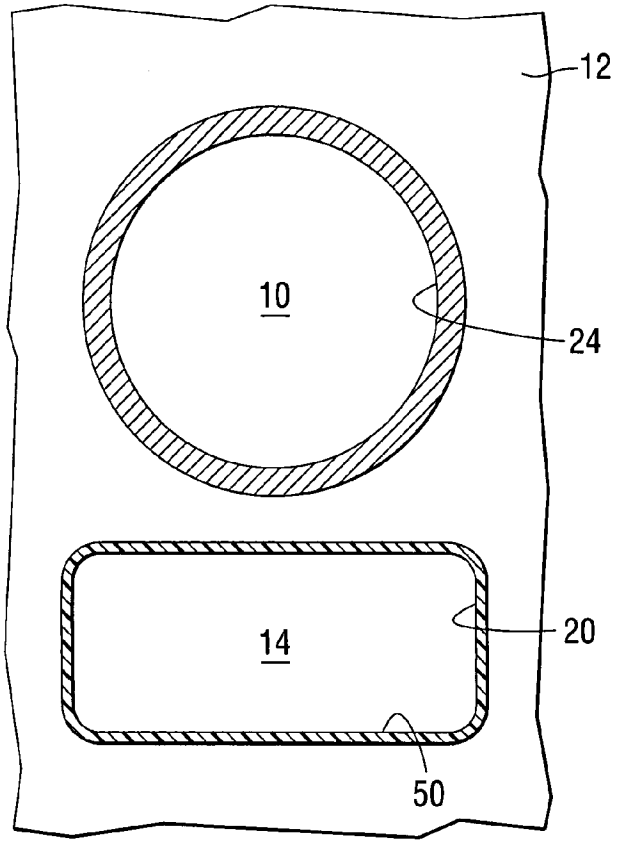
FIG. 1 PRIOR ART

FIGS. 1 and 2 are simplified schematic representations of two systems that have been used to address the problems described above with the intent of increasing the temperature differential between the cooling liquid flowing through cooling channels of the engine and the internal temperatures of the cylinder.

In FIG. 1, cylinder 10 is schematically shown formed within the body 12 of an engine block. A cooling channel 14 is shown formed within the engine block near the cylinder 10. The purpose of the cooling channel 14 is to remove heat from the engine block 12 which is generated in the cylinder 10. In FIG. 1, a coating 20 is provided on the internal surface of the coolant passage 14. In certain known applications, this coating 20 is an electro-deposited paint (EDP) in which an epoxy based paint is deposited on all of the internal walls of the cooling passages 14. This coating 20 provides a degree of insulation between the heat within the cylinder 10 and the water flowing through the cooling passage 14. Also shown in FIG. 1 is a cylinder liner 24 which, as is generally known to those skilled in the art, is typically made of a gray cast iron which can have graphite flakes within its structure. In a typical application of cylinder liners 24, as currently known to those skilled in the art, the wall thickness of the cylinder liner 24 is typically in the range of 0.060 inches to 0.50 inches.

In FIG. 2, the coolant passage 14 is not coated with an electro-deposited paint as described above in conjunction with FIG. 1, but the cylinder liner 24 is provided with an outer surface that results in a partial air gap 28 between portions of the outer surface of the cylinder liner 24 and the inner surface of the cylinder wall. The air gaps 28 can be provided in several ways that are generally known. As an example, the techniques described in U.S. patent application Ser. No. 10/793,000 (M09720) can achieve this type of air insulation region between the liner 24 and the internal cylindrical walls of the cylinder 10. This can be achieved by machining grooves or channels in the outer surface of the liner 24.

Figure 3:
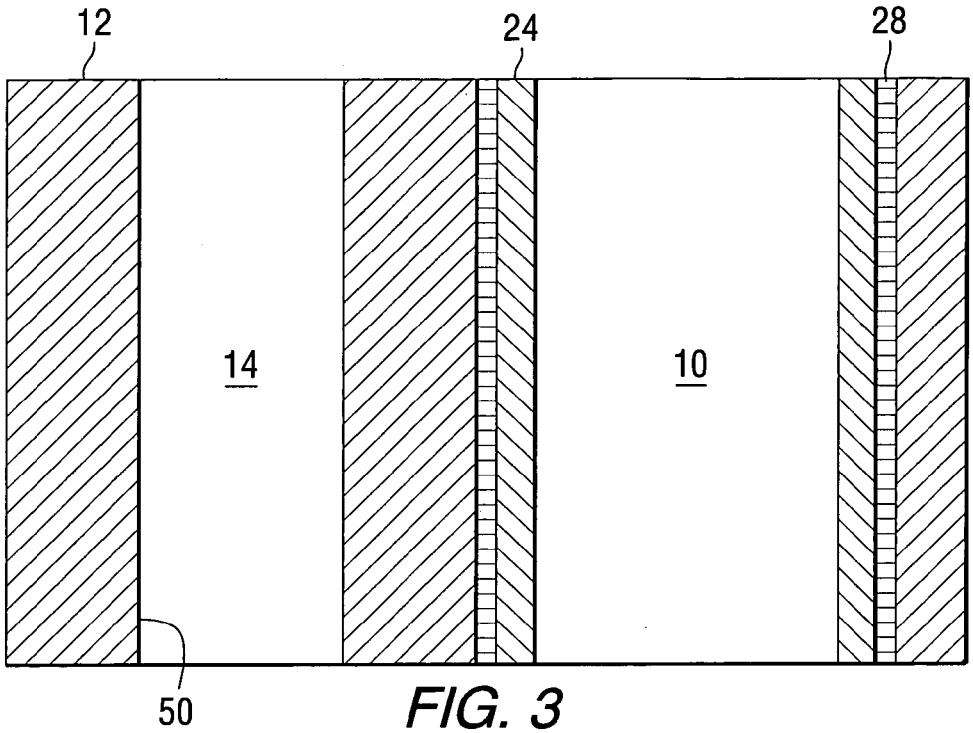
FIG. 3 PRIOR ART
FIGS. 3 and 4 are side section views of known devices such as those described in FIGS. 2 and 1.

FIG. 3 is a side section view of a system such as that described above in conjunction with FIG. 2. The cylinder liner 24 is provided with an external surface that results in air passages between it and the inner surface of the cylinder 10. These air gaps 28, formed by grooves or threads, provide a degree of thermal insulation between the temperature within the cylinder 10 and the temperature of the engine block 12 and the water flowing through the coolant passage 14.

Figure 4:
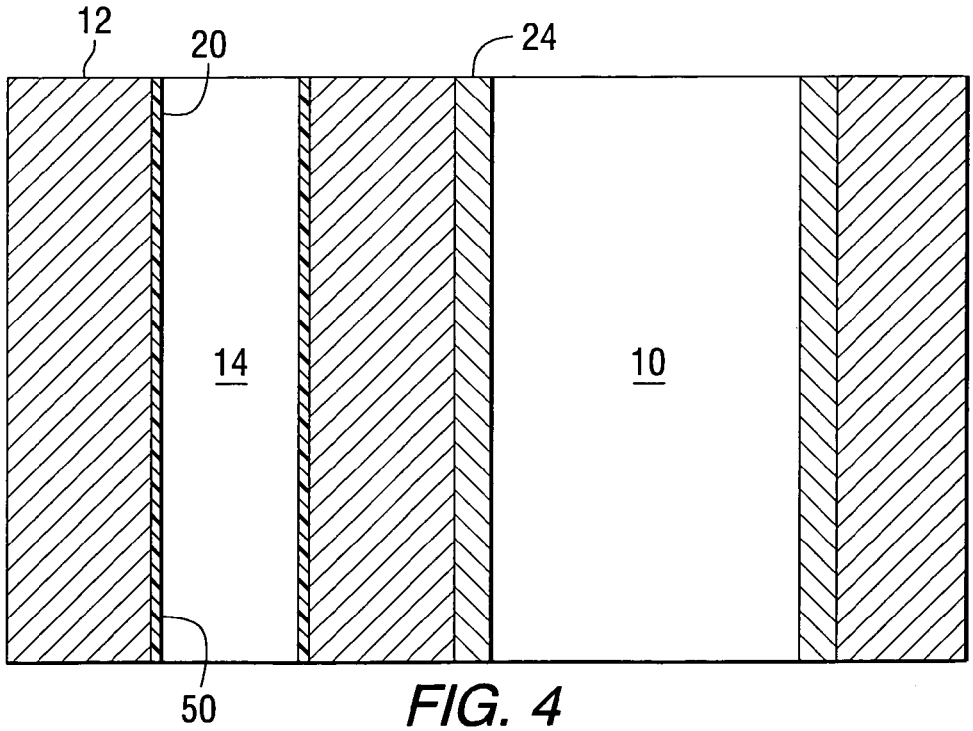
FIG. 4 PRIOR ART

FIG. 4 is a side section view of the structure described above in conjunction with FIG. 1. The coating 20 of electro-deposited paint (EDP) is shown in the inner surfaces of the cooling channel 14. The liner 24 is shown disposed within the cylinder 10.

Figure 5:
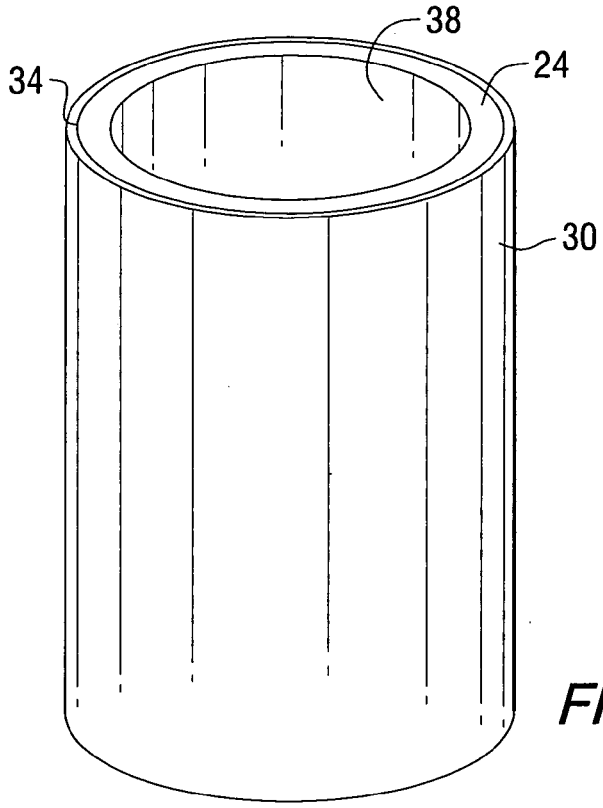
FIG. 5 is an isometric view of one embodiment of the present invention.

FIG. 5 is an isometric view of the present invention in its general form. A cylinder liner 24, which can be made according to known techniques, is provided with a layer of material 30 that is disposed between the outer surface 34 of the liner 24 and inner surface of the cylinder (not shown in FIG. 5). The layer of material 30 is selected from the group of materials consisting of ceramics and polymers. In other words, the layer of material 30 is a nonmetallic material. The inner surface 38 of the liner 24 defines the dimensions of the effective internal cavity of the cylinder when the engine is completed. This characteristic is true for the present invention and also for the prior art devices described above in conjunction with FIGS. 1–4.

Figure 6:
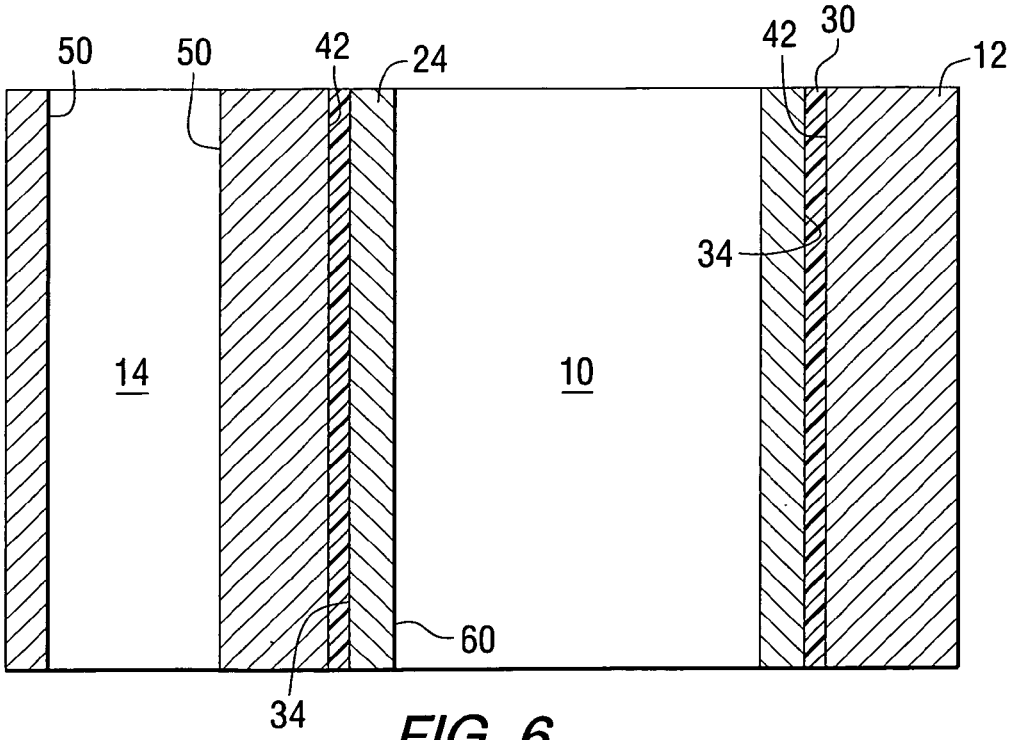
FIG. 6 is a simplified sectional view of the present invention.

FIG. 6 is a side section view of the present invention disposed within a block 12 of an internal combustion engine. In FIG. 6, the liner 24 has the layer of material 30 disposed between an outer surface 34 of the liner 24 and an inner surface 42 of the cylinder. The water passage 14 is shown in FIG. 6.

In a particularly preferred embodiment of the present invention, the layer of material 30 is provided to increase the degree of thermal insulation between the surface of the cylinder liner 60 and the surface of the cooling passage 50. As described above, in an open cooling system of a marine propulsion device, it is important to maintain the temperature of the cooling water within the cooling passage 14 below a magnitude of approximately 140 degrees Fahrenheit in order to avoid the deposition or plating of salts and other minerals on the internal walls 50 of the cooling system. As also described above, open cooling systems for marine propulsion devices also present a conflicting goal of maintaining the internal temperature within the cylinder 10 at a magnitude greater than 300 degrees Fahrenheit in order to assure proper combustion and minimize oil dilution. In order to achieve these goals, the present invention provides an improved degree of insulation between the cylinder 10 and the cooling channel 14. This improved thermal insulation is achieved by providing the coating of material 30 between the liner 24 and the inner surface 42 of the cylinder.

Figure 7:
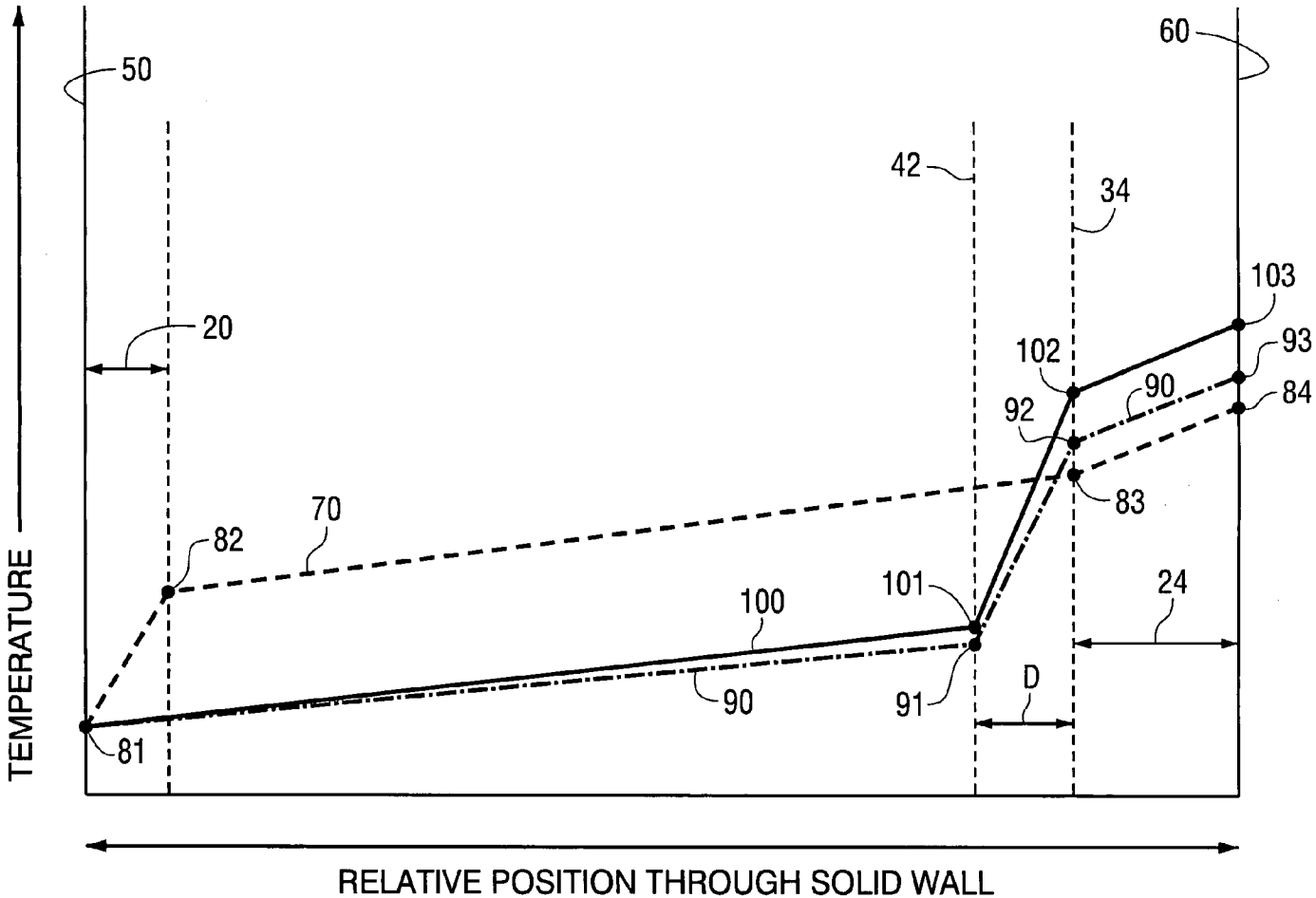
FIG. 7 is a graphical illustration of temperature profiles of the present invention and two other systems known to those skilled in the art.

In FIG. 7, the vertical axes represent temperature and the horizontal axis represents the relative position between the inner surface 50 of the water passage 14, as described above in conjunction with FIGS. 1–4 and 6, and the inner surface 60 of the cylinder 10. It should be understood that the inner surface 60 of the cylinder liner 24 is disposed radially inwardly from the inner surface 42 of the cylindrical opening formed within the engine block 12 to receive the cylinder liner 24. For purposes of describing the structure and operation of a preferred embodiment of the present invention, the inner surface 60 of the cylinder 10 shall be used to define the surface along which a piston travels in sliding association with the liner 24.

With continued reference to FIG. 7, several other important dimensions are illustrated. The thickness of the electro-deposited paint 20 is shown adjacent to the inner surface 50 of the water passage in the graphical representation of FIG. 7.

The thickness 24 of the cast iron liner is illustrated immediately proximate to the inner surface 60 along which the piston of the engine moves. Dimension D represents the thickness of the space between the outer surface 34 of the liner 24 and the inner surface 42 of the cylinder opening formed in the aluminum engine block 12.

Three temperature profiles are shown in FIG. 7. Line 70 represents a system, generally similar to the one described above in conjunction with FIGS. 1 and 4, in which an electro-deposited coating 20 is deposited on the inner surfaces of the cooling passages 14. With reference to line 70, the temperature at the surface which is in contact with the water within the cooling passage 14 is represented at point 81. Point 82 represents the temperature at the location between the electro-deposited paint 20 and the metallic surface (e.g. aluminum) of the engine block surrounding that layer of paint associated with the cooling passages 14. The increase in temperature magnitude is the result of the insulative capabilities of the electro-deposited paint 20. Between point 82 and point 83 in FIG. 7, the temperature rises continuously through the aluminum structure of the engine block 12 to the outer surface 34 of the cast iron cylinder liner 24. Since the gray cast iron of the cylinder liner 24 is more thermally insulative than the aluminum of the engine block 12, the rise in temperature profile increases slightly faster between points 83 and 84 than between points 82 and 83.

With continued reference to FIG. 7, line 90 represents the temperature profile resulting from the use of an air gap or partial air gap between the outer surface 34 of the cylinder liner 24 and the inner surface 42 of the cylinder opening in the engine block 12. For purposes of this graphical illustration, the surface temperature of the cooling water passage 81 is assumed to be the same as in the previous example relating to line 70. Since no electro-deposited paint 20 is used, the temperature profile is generally consistent between points 81 and 91. The insulative characteristic of the air gap in the space identified by reference letter D in FIG. 7 results in a relatively steep temperature profile between points 91 and 92. A change in temperature through the thickness of the liner 24, shown between points 92 and 93, is generally parallel to that described above in conjunction with points 83 and 84.

It can be seen that the use of an air gap D results in a noticeable improvement between the characteristics shown by lines 70 and 90 in FIG. 7. The temperature differential between points 81 and 93 is greater than the differential between points 81 and 84. This allows a greater temperature difference is between the water flowing through the cooling passages 14 and the temperature at the inside surface of the cylinder liner 24. This increased difference helps to avoid both the deposition of salts and other minerals on the walls of the cooling passages 14 and helps to discourage oil dilution and imperfect combustion in the cylinders.

With continued reference to FIG. 7, line 100 represents the temperature profile that is achievable through the use of the present invention. Using point 81 as in the previous examples, the temperature profile through the aluminum body of the aluminum engine block 12 is generally similar to that described above in conjunction with line 90. In other words, although lines 100 and 90 are shown being spaced apart by a slight amount in FIG. 7, for purposes of clarity and illustration, the temperature magnitudes at points 91 and 101 should be considered generally equal to each other. The temperature differential between points 81 and either point 91 or point 101 is the result of the flow of heat through the aluminum body of the engine block 12 and its thermal insulative capabilities. Through the thickness D of the layer of material 30, it can be seen that the increase in temperature between points 101 and 102 is greater than the increase between points 91 and 92 as described above in conjunction with line 90. The temperature profile between points 102 and 103 is generally similar to those between points 92 and 93 and between points 83 and 84. This is due to the fact that the same type of cast iron liner 24 is used in all three examples. The important advantage provided by a preferred embodiment of the present invention is the difference in temperature profile between points 101 and 102 in space D compared to the alternatives. In other words, the insulative capabilities of the layer of material 30, exhibited through the space identified by dimension D in FIG. 7, results in a greater temperature differential between points 81 and 103 than in either the difference between points 81 and 93 or between points 81 and 84.

Another advantage of the invention is that the aluminum structure in the invention is at a lower temperature 100 compared to the temperature that the aluminum would have been 70 if an insulative coating was placed on the surface of the water passage. This lower aluminum temperature provides numerous advantages that are recognized by one skilled in the art such as superior strength of the aluminum at lower temperature, reduced thermal expansion, and better clamp load retention of fasteners.

As described above, marine engines using open cooling systems are unique compared to either automotive engines or marine engines using closed cooling systems. Open cooling systems in marine engines use seawater or freshwater which is typically mineral-laden. Because this cooling water contains minerals or salts, the operating temperature of the engine water passage surface 81 should be maintained under approximately 140 degrees Fahrenheit so that these minerals and salts do not plate out from the cooling water onto the surfaces of the cooling passages 14. Because of this relatively low temperature requirement, the fuel provided to the combustion chambers and cylinders of the engine may not fully vaporize because of the correspondingly lower temperatures of the walls of the cylinder. This lack of vaporization can result in liquid fuel being introduced into lubricating oil that is present on the walls of the cylinders. This phenomenon, which is referred to as oil dilution, reduces the viscosity of the engine oil. This reduced viscosity can lead to increased wear and even catastrophic engine failure under certain circumstances. As also described above, the addition of an electro-deposited paint (EDP) on the internal water passages has been tried and provides some improvement to this condition. It increases the temperature differential between the temperature of the water flowing through the cooling passages and the temperature within the cylinders. Grooves have also been cut into the outer surface of the cylinder liner or the inner surface of the cylindrical opening within the engine block in order to use air as an insulator between the liner and the engine block.

In automotive systems, the challenge is often to design closed loop cooling systems that extract enough heat from the engine's cylinders. In marine systems, use of a large reservoir of cold lake water or seawater for open loop cooling challenges the ability to retain enough heat in the engine cylinders for proper fuel vaporization.

A preferred embodiment of the present invention places an additional thermally restricting layer in the system between the internal cavity of the engine's cylinders and the water passages. The insulating layer in a preferred embodiment of the present invention is either a polymeric or ceramic material. In other words, a preferred embodiment of the present invention uses a nonmetallic material 30. Various polymers can be used and applied to the external surface of the liner or to the cylindrical bore in the engine block 12. Various processes are known to those skilled in the art to apply, for example, polyether ether ketone (PEEK) on the external surface of the liner. Alternatively, a shrink wrap sheath of PEEK can be placed on the cylinder liner, as a polymer sleeve, and then heated to shrink and form the layer of material tightly around the outer surface of the liner. Alternatively, the polymer can be injection molded around the liner. If a ceramic material is used, a preferred embodiment of the present invention could use zirconia (zirconium oxide) or yttria (yttrium oxide) as thermal barriers between the liner and the bore in the block. These ceramic materials can be applied to the liner, or to the bore of the cylinder in the block, by flame spraying, traditional frit applications, or any other suitable technique. In addition, it should be understood that the material need not be uniform in thickness, in a radial direction, in all embodiments of the present invention.

Although either polymers or ceramics can be used as the layer of material in preferred embodiments of the present invention, it should be understood that polymers provide the possibility that no additional machining is necessary to achieve appropriate relative size configurations. In other words, a PEEK sheath can be applied to a cylinder and heated to result in an outer diameter that is not significantly different than the gray cast iron cylinder liner itself. If a ceramic is used, it is likely that machining of the outer surface of the cylinder liner would be needed to achieve the proper dimension. This is due to the fact that the more common methods to apply ceramic insulative films result in thicker films with higher thickness variation than is generally desired. After the insulative material is applied to the cast iron cylinder liner, the assembly is then inserted into the cylindrical openings of the engine block by heating the block to expand its size and/or cooling the cylinder liner to decrease its size. After assembly, the engine block and cylinder liner achieve identical temperatures and the liner is then permanently seized within the engine block structure. As an alternative manufacturing technique, the liners can possibly be placed in a mold and the engine block can be cast around the prefabricated liner and insulative coating.

In a particularly preferred embodiment of the present invention, the polymer layer on the liner is between 0.005 millimeters and 5 millimeters thick. Although this range is not limiting to all embodiments of the present invention, it is believed that most engine applications can benefit significantly from a layer of material within this thickness range. When a ceramic material is used as the layer of material of the present invention, its preferred thickness is between 0.05 millimeters and 2 millimeters. Many different processes can be used to apply the layer of material to the cylinder liner, such as shrink fitting a polymer sheath, thermal spraying a ceramic material, or thermal spraying a polymer material. An electro-deposited paint can be applied to the outer surface of the cylinder liner. In some applications, it may be desirable for cost considerations to avoid masking and to completely coat the cylinder liner on its inside and outside surfaces and then machine the internal cylindrical surface of the liner to achieve the appropriate dimensions. This machining of the internal surface would naturally remove the EDP material. Powder coating is also a possible technique for applying the layer of thermally insulative material.

In order to minimize selective hot or cold areas in the cylinder liners, due to inherent engine cylinder configurations, certain predetermined areas of the cylinder liner may be coated with an insulating material. This may be typically made by masking certain areas of the cylinder liner during the coating process to selectively coat other areas. This allows an engine designer to have a more uniform temperature distribution around the entire cylinder liner thereby avoiding bore distortion from thermally-induced stresses. An example that routinely occurs in multiple cylinder engine applications is the region disposed between adjacent cylinders, called the "bore bridge", is typically hotter than the remainder of the liner.

This concept can be extended to placing multiple materials selectively around the circumference of the cylinder liner 24 or engine bore 10 to tailor the overall thermal distribution about the cylinder liner. In certain applications a metallic material could be used in combination with a polymeric or ceramic material. In an engine with severe thermal management issues, a metallic material could conduct heat away from an unusually hot area of a cylinder liner (e.g. a "bore bridge" area), and a polymer or ceramic material used to insulate cold areas of a cylinder (e.g. 90 degrees displacement from the "bore bridge" area). This equalizes temperature distribution about the cylinder and avoids bore distribution.

Although a preferred embodiment of the present invention places the thermal material on the outer surface of the cylinder liner prior to assembly of the cylinder liner into the engine cylinders, alternative embodiments could dispose the insulative material on the inner surface of the engine block's cylinders prior to the insertion of a cast iron cylinder liner.

Although the present invention has been described with considerable detail and illustrated to show a preferred embodiment, it should be understood that alternative embodiments are also within its scope.

We claim:

1. An engine, comprising:

a cylinder;

a liner disposed in said cylinder; and a layer of polyether ether ketone material disposed between an outer surface of said liner and an inner surface of said cylinder.

2. The engine of claim 1, wherein:

said polyether ether ketone material has a glass transition temperature characteristic which is higher than the maximum operational temperature of said liner when said engine is operating.

3. The engine of claim 1, wherein:

said layer of material is disposed on said outer surface of said liner prior to the disposal of said liner into said cylinder.

4. The engine of claim 1, wherein:

said material is sprayed onto said outer surface of said liner.

5. The engine of claim 1, wherein:

said material is shrunk onto said outer surface of said liner prior to assembly of said liner into said cylinder.

* * * * *